US007207689B2

(12) United States Patent
Tait

(10) Patent No.: US 7,207,689 B2
(45) Date of Patent: Apr. 24, 2007

(54) TOUCH ACTIVATED PURSE ILLUMINATION ASSEMBLY

(76) Inventor: Cindy Tait, 3747 Arlington Ave., Riverside, CA (US) 92506

( * ) Notice: Subject to any disclaimer, the term of this patent is extended or adjusted under 35 U.S.C. 154(b) by 190 days.

(21) Appl. No.: 10/746,470

(22) Filed: Dec. 23, 2003

(65) Prior Publication Data

US 2005/0135083 A1 Jun. 23, 2005

(51) Int. Cl.
*A45C 15/06* (2006.01)
*F21V 33/00* (2006.01)

(52) U.S. Cl. ..... 362/156; 362/191; 362/208; 362/577; 362/581

(58) Field of Classification Search ..... 362/154–157, 362/570, 191, 208, 577, 581
See application file for complete search history.

(56) References Cited

U.S. PATENT DOCUMENTS 3,535,282 A * 10/1970 Mallory ..... 200/60
3,784,760 A * 1/1974 Rickert ..... 379/442
4,063,111 A * 12/1977 Dobler et al. ..... 307/116
4,099,074 A * 7/1978 Maeda et al. ..... 307/116
4,164,008 A * 8/1979 Miller et al. ..... 362/103
4,521,835 A * 6/1985 Meggs et al. ..... 362/470
4,623,957 A * 11/1986 Moore et al. ..... 362/200
4,875,147 A * 10/1989 Auer ..... 362/205
5,018,057 A * 5/1991 Biggs et al. ..... 362/295
5,067,063 A * 11/1991 Granneman et al. ..... 362/156
5,073,844 A * 12/1991 Coyner et al. ..... 362/156
5,138,538 A * 8/1992 Sperling ..... 362/295
5,634,710 A * 6/1997 Di Russo et al. ..... 362/100
5,678,913 A * 10/1997 Ishimaru et al. ..... 362/555
5,934,790 A * 8/1999 Quintana et al. ..... 362/156
5,980,063 A * 11/1999 Ford et al. ..... 362/555
6,337,946 B1 * 1/2002 McGaffigan ..... 362/555
6,388,390 B2 * 5/2002 Rachwal ..... 315/200 R
6,650,066 B2 * 11/2003 Bruwer ..... 315/200 A
6,776,501 B2 * 8/2004 Burnidge ..... 362/156
6,857,771 B2 * 2/2005 Guerrieri ..... 362/555
2002/0114168 A1 * 8/2002 Pelka et al. ..... 362/555
2002/0131275 A1 * 9/2002 Yamamoto et al. ..... 362/555
2004/0114386 A1 * 6/2004 Hung ..... 362/555
2004/0141314 A1 * 7/2004 Vautrin et al. ..... 362/156
2005/0047120 A1 * 3/2005 Sargent ..... 362/156
2005/0057923 A1 * 3/2005 Kurcz et al. ..... 362/156

* cited by examiner

*Primary Examiner*—Sandra O'Shea
*Assistant Examiner*—Ismael Negron
(74) *Attorney, Agent, or Firm*—Jennifer Meredith, Esq; Meredith & Keyhani, PLLC

(57) ABSTRACT

A touch-activated purse illumination assembly having a base unit housing a circuit assembly, a power source and at least one elongated light emitting portion. Touch sensitive switching means are included in the circuit assembly, and feature a pair of partially exposed electrical contacts on the exterior of the base housing unit. After being activated by the touch sensitive switching means, the light emitting portion is energized by the power source for a preset amount of time.

23 Claims, 3 Drawing Sheets

TOUCH ACTIVATED PURSE ILLUMINATION ASSEMBLY

BACKGROUND OF THE INVENTION

The present invention generally relates to illumination devices specifically for use in purses, handbags and backpacks that allow the user to easily activate and illuminate its interior. The use of small lights as a means for illuminating a purse is known within the art. These may include traditional pocket lamps that hang from a strap down into a purse and must be switched on by the user or light systems built into a purse, which would illuminate upon opening the purse.

By way of example, U.S. Pat. No. 6,447,142 issued to Weir describes a purse light system. The purse light system is a purse with a built in light system, which includes a purse outer structure, a battery pack and a light assembly positioned to emit light into the purse chamber. The purse lighting system automatically switches on when the purse opening is in the open position and off when the purse opening is in the closed position. As many people have more than one purse, this lighting system is impractical, as it does not allow the user to use the illumination device for other purses. Also, many purses illuminate from the top down, which is not as effective as the present invention which emits light from the bottom of the purse or handbag.

Another purse lighting system, U.S. Pat. No. 5,424,926 issued to Meyers describes a purse light. This purse light includes a light for illuminating the interior of a purse, consisting of a mounting assembly housing a light bulb, a reflector to direct the light towards a diffusing lens which projects the light in a multitude of directions and a digital clock.

U.S. Pat. No. 6,508,568 issued to Blue-Recio discloses yet another Light Assembly for the interior of a purse. The Light Assembly consists of a mounting structure to secure the assembly to the inside of a bag. An illumination source which projects light to the interior of the bag, and a switch the user must push to turn the purse light on. The switching mechanism for the '598 patent may allow for the lamp to be inadvertently switched on by pressure from items within the purse which, and may also allow for the lamp to be inadvertently left on by the user, both instances may result in complete discharge of the battery without the knowledge of the user.

U.S. Pat. No. 4,742,438 issued to King describes a light for the interior of a purse, having a light bulb, an electric power supply mounted within a translucent housing which is temporarily mounted on a mounting bracket which is permanently attached to the inside of a purse. Although the '438 patent can be used in multiple bags, it is still impractical because it requires mounting brackets to be permanently mounted on the interior of a purse.

While these devices serve their specific purposes, the aforementioned patents do not disclose a purse lamp for use in a handbag with a flexible illumination assembly, connected to an electric power supply that can be switched on by the mere touch of the users hand. The present invention can also be conveniently and easily moved from one purse to another. The prior art does also not disclose a purse lamp with a timed illumination period, automatically switching the purse light off after a given period of time, protecting the lamp from inadvertent illumination resulting in a prematurely drained battery.

SUMMARY OF THE INVENTION

The present invention provides a purse illumination assembly that is touch activated. The light automatically deactivates at a preset time, providing a compact, durable, energy efficient illumination device that can be used in a multitude of bags. By way of example this may be handbags, purses, backpacks.

According to one embodiment, a purse illumination assembly is disclosed, the device comprising: a base housing unit; a circuit assembly partially contained within the base housing, wherein the circuit assembly is comprised of a touch sensitive switching means exposed on the exterior of the base housing unit and a power source providing a timed and regulated conveyance of electricity. The purse illumination device further comprises at least one elongated light emitting portion having a first end fixedly attached to the base housing unit and a terminal end, the light emitting portions being in electrical communication with the circuit assembly.

According to another embodiment, a purse illumination assembly is disclosed, the device comprising: a substantially rectangular base housing unit having a front end, a back end and four longitudinal sides, wherein at least one longitudinal side is removably attachable to said base housing unit. The device further comprises a touch sensitive switching means partially contained within the base housing unit consisting of two non-intersecting electrical contacts exposed on at least one of the longitudinal sides of the base housing unit. A power source is also contained within the base housing unit. A circuit assembly partially contained within said base housing is in electrical communication with both the touch sensitive switching means and the power source providing a timed and regulated conveyance of electricity. The illumination assembly further comprises, a first flexible tubular translucent elongated light emitting housing having a first end fixedly attached to the front wall of the base housing unit and a terminal end; and at least one light emitting element contained within the light emitting portion being in electrical communication with the circuit assembly.

According to another embodiment, a purse illumination assembly is disclosed, the device comprising: a substantially rectangular base housing unit having a front end, a back end and four longitudinal sides, wherein at least one longitudinal side is removably attachable to said base housing unit, and one longitudinal side has two recessed indentations. A touch sensitive switching means partially contained within said base housing unit having two non-intersecting electrical contacts exposed within the two recessed indentations on the longitudinal side of the base housing unit. The illumination assembly further comprises, a circuit assembly partially contained within the base housing in electrical communication with the touch sensitive switching means and a power source. The circuit assembly also has a capacitive timing element, providing a timed and regulated conveyance of electricity. A rechargeable power source is contained within the base housing unit and in electrical communication with an electrical recharging contact and partially contained within the base housing. A first light emitting housing that is elongated, flexible, tubular and translucent has a first end fixedly attached to the front wall of the base housing unit and a terminal end. A second light emitting housing that is elongated, flexible, tubular and translucent has a first end fixedly attached to the front wall of the base housing unit and a terminal end. A voltage high electrical lead in electrical communication with a voltage high terminal of the power source and a voltage low electrical lead in electrical communication with a voltage low terminal of the power source extend through the base housing unit and extend down the first and the second flexible tubular translucent light emitting housing. At least one light emitting diode contained within the first and second light emitting housings are in parallel electrical communication with the voltage high and the voltage low lead. The present invention further comprises an attachment means fixedly attached to the base housing unit providing a purse assembly that is removably attached to the interior of the purse.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention generally provides an illumination device that may be used in conjunction with a handbag. The present invention provides a durable purse illumination device that is easily illuminated by the touch of the users hand, has a timed illumination period, and is easily interchanged between a myriad of various bags.

Figure 1A:
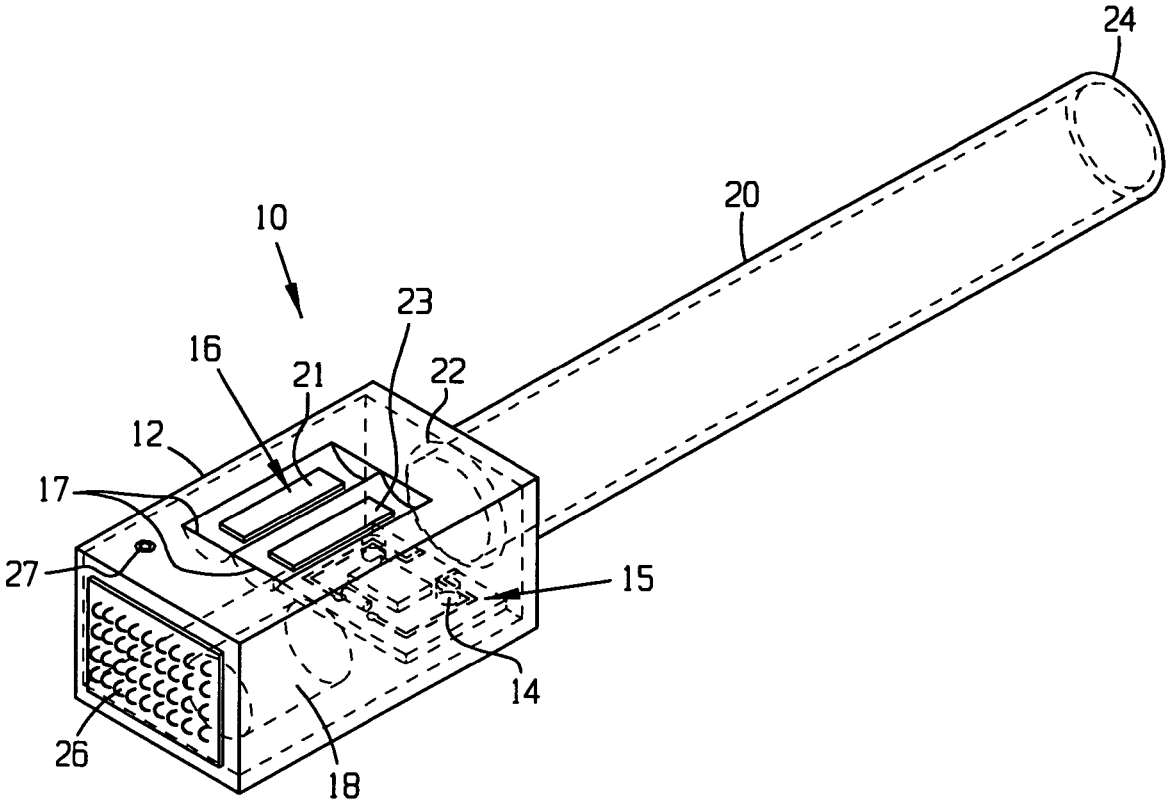
FIG. 1A is a perspective view of a purse illumination assembly according to an embodiment of the present invention.

Referring to FIG. 1A, a purse illumination assembly 10 is disclosed, comprising a base housing unit 12 a timing circuit 14, circuit assembly 15 and a light-emitting portion 20. The base housing unit 12 may have a generally rectangular shape with two ends, and four longitudinal sides. At least one of these longitudinal sides may be a removable side providing access to the interior of the base housing unit 12 for tasks such as replacing the power source 18, or fixing other electrical elements therein. The exterior of the base housing unit 12 may have two recessed indentations 17. The recessed indentations 17 may contain the touch sensitive switching means 16 therein. These two indentations 17 may be deep enough as to shield the touch sensitive switching means 16 from inadvertent actuation by items contained within the purse but are of a depth that allows the user to intentionally actuate the touch sensitive switching means 16.

The base housing unit 12 may further comprise an attachment means 26 fixedly attached thereto providing a purse illumination assembly 10 that is removably attachable to the interior of the purse. The attachment means 26 may be VELCRO® (e.g. hook and look type fasteners) in which one side of the VELCRO® (e.g. hook and look type fasteners) attachment means is affixed to the base housing unit 12 by an adhesive, and the other side of the VELCRO® (e.g. hook and look type fasteners) is attached to the interior of the purse. Another possible attachment means may be a U shaped clip with a spring like closing effect. One side of the clip may be fixedly attached to a side of the housing 12, the other side may slipped over an interior pocket of a purse providing a purse illumination assembly 10 that is secured to the interior of a purse.

The circuit assembly 15 is partially contained within the base housing unit 12, wherein the circuit assembly 15 is comprised of a touch sensitive switching means 16 exposed on the exterior of the base housing unit 12, a power source 18 and a timing circuit 14 providing a timed and regulated conveyance of electricity. The touch sensitive switching means 16 may extend through the base housing unit 12 and are exposed on the exterior of the base housing unit 12. The touch sensitive switching means 16 may also be exposed on the exterior of the light-emitting portion 20, and may be comprised of a first electrical contact 21 and a second electrical contact 23 which are non-intersecting. The bridging of the first contact 21 and second contact 23 will illuminate the light-emitting portion 20 for a given amount of time before automatically shutting off. The purse illumination assembly 10 may implement a timing circuit 14, which may be a capacitive timing circuit, which uses the charging and discharge of a capacitor, to regulate the duration of illumination. The purse illumination assembly may also further comprise a second light-portion.

A power source 18 in communication with the circuit assembly 15 may consist of at least one disposable power cell, rechargeable cell or solar powered cell. The illumination assembly 10 may further comprise an electrical contact 27 partially contained within the base housing unit 12 in electrical communication with the power source 18. This electrical contact 27 allows a conventional battery-charging device to be in removable electrical communication with the power source 18 of the purse illuminating assembly 10. The user may attach one end of a battery charging unit to the electrical contact 26 in communication with the illumination assembly power source 18, and the other end of the battery charging unit to a battery charger receptacle, providing a rechargeable purse illumination assembly 10. The illumination assembly may have a first end 22 fixedly attached to the base housing unit 12 and a terminal end 24.

Figure 1B:
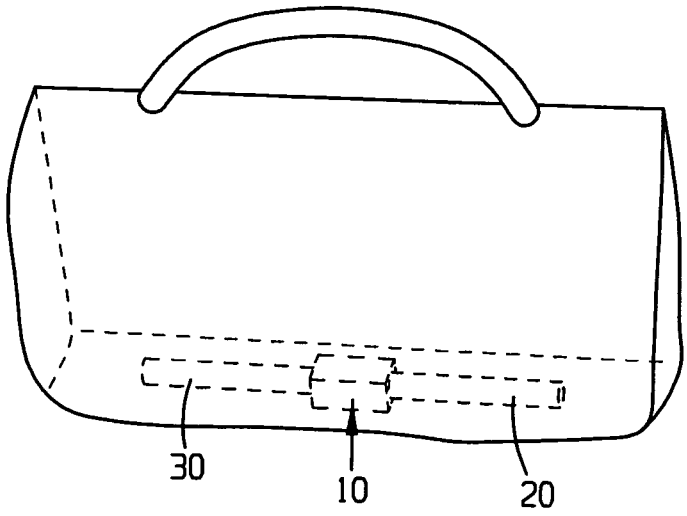
FIG. 1B is a perspective view of a purse illumination assembly according to an embodiment of the present invention.

As shown in FIG. 1B, according to a preferred embodiment it is intended that the illumination assembly 10 be along the bottom of the purse to provide bottom up illumination. This is one of the many advantages of the present invention in relation to the prior art in that bottom up illumination provides much better viewing of the contents of the purse, handbag or the like. As also shown in FIG. 1B, the purse illumination assembly may comprise a first light-emitting portion 20, and a second light-emitting portion 30.

Figure 2:
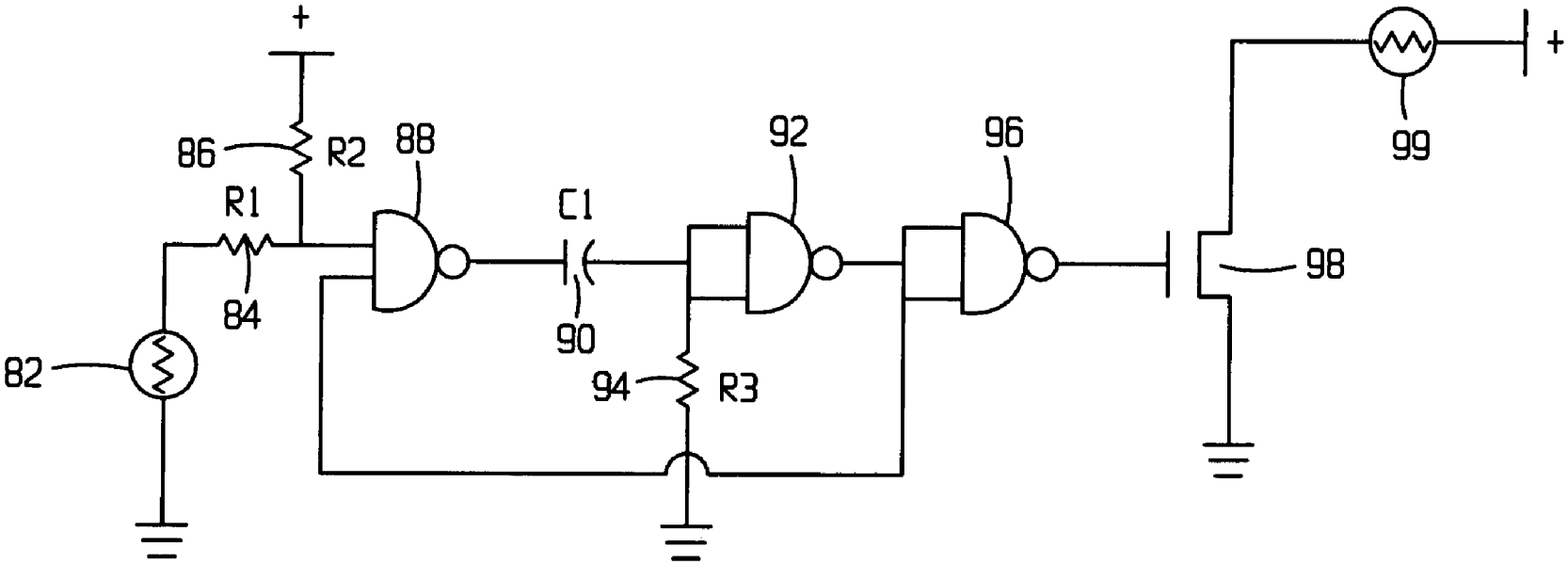
FIG. 2 is a circuit schematic according to an embodiment of the present invention.

FIG. 2 depicts a complimentary metal-oxide semiconductor (CMOS) circuit electronic circuit 80 which may control the illumination of the illumination element(s) 99. When the touch sensor is not actuated, the touch sensor 82 acts as an open circuit and therefore the voltage at the first input of the first NAND gate 88, is a voltage high, voltage high may range from 3 Volts to 6 Volts. The second input of the first NAND gate 88, is also a voltage high. By the nature of a NAND gate, the output of the NAND gate 88 is a voltage low, voltage low ranges from 0 Volts to 2 Volts. A voltage low exists on both the positive side and the negative side of the Capacitor C1, 90. Subsequently, both inputs to the second NAND gate 92 are a voltage low. By the nature of the NAND gate, the output of the second NAND gate 92 is a voltage high, this voltage high is the feedback to the second input of the first NAND gate 88, and is both inputs to the third NAND gate 96. By the nature of the NAND gate, the output of the third NAND gate 96 is a voltage low. When the voltage of the N-Mosfet gate 98 is low, the gate voltage does not overcome the threshold voltage of the Mosfet, and no conducting channel exists between the drain and source of the Mosfet. When the circuit is open between the drain and source of the Mosfet, the lighting circuit is not complete, and the illumination elements will not illuminate.

In/order to illuminate the purse illumination assembly the touch sensor must be actuated. When the touch sensor 82 is actuated, a voltage divider comprised of resistors R1 84 and R2 86 is formed and the voltage at the first input of the first NAND gate 88, is a voltage low. Regardless of the voltage of the second input of the first NAND gate 88 by the nature of a NAND gate, the output of the NAND gate 88 is a voltage high. A voltage high exists on both the positive side and the negative side of the Capacitor C1, 90. Subsequently, both inputs to the second NAND gate 92 are a voltage high. By the nature of the NAND gate, the output of the second NAND gate 92 is a voltage low which is the feedback to the second input of the first NAND gate 88, and is both inputs to the third NAND gate 96. By the nature of the NAND gate, the output of the third NAND gate 96 is a voltage high. When the voltage of the N-Mosfet gate 98 is a voltage high, the gate voltage exceeds the threshold voltage of the Mosfet 98, and a conducting channel exists between the drain and source of the Mosfet 98. When the circuit is closed between the drain and source of the Mosfet 98, the lighting circuit is complete, and the illumination elements 99 illuminate.

The timing element of the illumination circuit is controlled by the capacitor C1, 90, and R3, 94. Once capacitor C1 90 is charged by the actuation of the touch sensor 82, it discharges through the resistor R3 94. Once the charge of the capacitor C1 90 decreases to a certain level the input to the second NAND gate 92 changes from a voltage high to a voltage low. The output of the second NAND gate 92, changes from a voltage low to a voltage high, the output of the third NAND gate 96 changes from a voltage high to a voltage low, and the illuminating elements 99 subsequently shut off.

Figure 3:
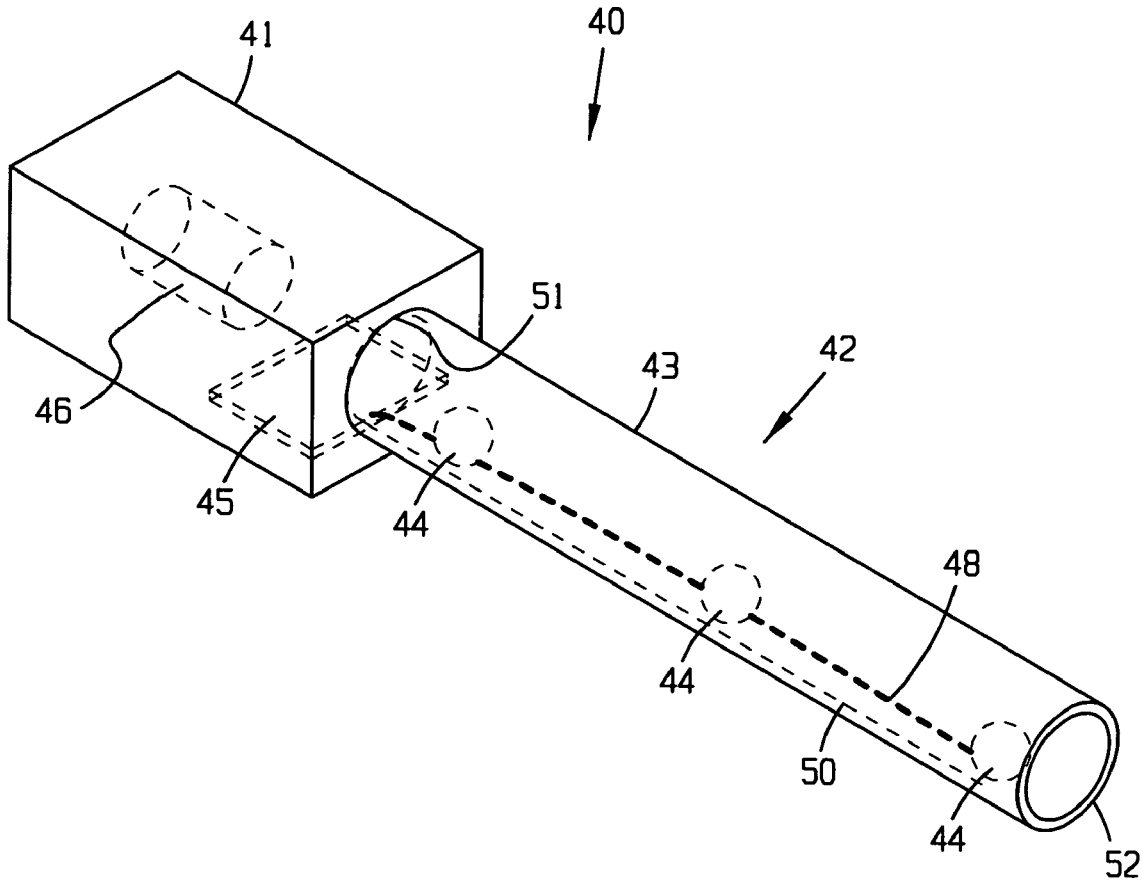
FIG. 3 is a perspective view of a purse illumination assembly according to an embodiment of the present invention.

FIG. 3 depicts a light-emitting portion 42 in electrical communication with the circuit assembly 45. The light-emitting portion 42 may be of a length ranging from 2 inches to 10 inches, and may have a first end 51 fixedly attached to the base housing unit 41 and a terminal end 52. The light emitting portion 42 is comprised of a light emitting housing 43 and three light emitting elements 44 partially contained within the light emitting housing 43, wherein the light emitting elements 44 are in electrical communication with the circuit assembly 45. The present invention is not limited to 3 light emitting elements 44, but is envisioned to have from at least one light-emitting element 44 to a multitude of light emitting elements 44. The light emitting housing 43 may be a flexible translucent plastic tube. The light emitting element(s) 44 partially contained within the light emitting housing 43, may be light emitting diode(s) incandescent bulb(s), organic luminescent device(s) or fiber optic(s). The light emitting element(s) 44 contained within the light emitting housing 43 may be sourced from the power supply 46 contained within the base housing unit via a voltage high wire 48 and a voltage low wire 50 extending through the base housing unit 41 and extending the length of the light emitting housing 43. The light emitting elements(s) may be coupled to the voltage high wire 48, and the voltage low wire 50 in either a parallel fashion or a serial fashion.

In an alternate embodiment, the light-emitting portion 42 may consist of a light-emitting element partially contained within the base housing 41. The light emitting housing 43 may be either one or a multitude of optical fibers attached to the base housing unit 41, providing a fiber optic light emitter.

It should be understood that the foregoing relates to preferred embodiments of the invention and that modifications may be made without departing from the spirit and scope of the invention as set forth in the following claims.

The invention claimed is:

1. A purse illumination assembly, comprising:

a base housing unit having a front end, a back end and four sides, wherein at least one of the sides include a plurality of recessed indentations;

a circuit assembly partially contained within said base housing unit, said circuit assembly having touch sensitive switching means including a plurality of exposed electrical contacts located within respective ones of said plurality of recessed indentations on said at least one of the side of said base housing unit, said circuit assembly further having a power source;

at least one rigid and substantially cylindrical elongated light emitting portion having a first end fixedly attached to said front end of said base housing unit and a terminal end, said light emitting portion including a light source in electrical communication with said circuit assembly, wherein upon contact of a user hand with said plurality of exposed electrical contacts said circuit assembly activates said light source for preset period of time and automatically shifts off said light source after said preset period of time expires; and attachment means fixedly attached to at least one said back end and said four sides, said attachment means removably attaching said base housing unit to an interior surface of a purse.

2. An apparatus as in clam 1, wherein said touch sensitive switching means extend through said base housing unit exposed on the exterior of said base housing unit.

3. The apparatus as in claim 1 wherein said base housing unit is further comprised of a removable side for access to the interior of said base housing unit.

4. An apparatus as in clam 1, wherein said touch sensitive switching means extend through said base housing unit exposed on the exterior of said base housing unit and said light emitting portion.

5. An apparatus as in claim 1, wherein said touch sensitive switching means is comprised of two non-intersecting electrical contacts.

6. An apparatus as in claim 1, wherein said light emitting portion is at least one optical fiber.

7. The apparatus as in claim 1, wherein said power source is selected from the group consisting of disposable power cell, rechargeable power cell and solar powered cell.

8. An apparatus as in claim 1, wherein said light emitting portion is comprised of a light emitting housing and at least one light emitting element partially contained within said light emitting housing, wherein said at least one light emitting element is in electrical communication with said circuit assembly.

9. The apparatus as in claim 8, wherein said circuit assembly includes a capacitive timing element providing a set time of illumination.

10. An apparatus as in claim 8, wherein said elongated light emitting housing contains at least one light emitting element in electrical communication with said circuit assembly.

11. An apparatus as in claim 8, wherein said at least one light emitting element is selected from the group consisting of light emitting diode, incandescent bulb, organic luminescent device, fiber optic or combinations thereof.

12. An apparatus as in claim 8, further comprising a voltage high wire and a voltage low wire extending through said base housing unit and the length of said light emitting housing with said at least one light emitting element coupled thereto In a parallel fashion.

13. An apparatus as in claim 8, further comprising a voltage high wire and a voltage low wire extending through said base housing unit and the length of said light emitting housing with said at feast one light emitting element serially coupled thereto.

14. An apparatus as in claim 8, wherein said at least one light emitting element has a first electrical lead in electrical communication with a voltage high terminal of said power source and a second electrical lead in electrical communication with a voltage low terminal.

15. A purse illumination assembly, comprising:

a substantially rectangular base housing unit having a front end, a back end and four longitudinal sides, wherein at least one longitudinal side is removably attached to said base housing unit and at least one of the sides include a plurality of recessed Indentations;

a circuit assembly partially contained within said base housing in electrical communication with and having a touch sensitive switching means partially contained within said base housing unit and said circuit assembly further having two non intersecting exposed electrical contacts exposed on at least one of said longitudinal sides of said base housing unit and said circuit assembly further having a power source;

a first rigid and substantially cylindrical tubular translucent elongated light emitting housing having a first end fixedly attached to said front end of said base housing unit and a terminal end; and at least one light emitting element contained within said light emitting portion being in electrical communication with said circuit assembly, wherein upon contact of a user hand with said exposed electrical contacts said circuit assembly activates said light source for preset period of time and automatically shifts off said light source after said preset period of time expires; and attachment means fixedly attached to at least one said back end and said four sides, said attachment means removably attaching said base housing unit to an Interior surface of a purse.

16. The apparatus as in claim 15, wherein said circuit assembly includes a capacitive timing element providing a set time of illumination.

17. An apparatus as in claim 15, wherein said at least one light emitting element is selected from the group consisting of light emitting diode, incandescent bulb, organic luminescent device, fiber optic, or any combination thereof.

18. An apparatus as in claim 15, further comprising a voltage high wire and a voltage low wire extending through said base housing unit and the length of said right emitting housing with said at least one light emitting element coupled thereto in a parallel fashion.

19. An apparatus as in claim 15, further comprising a voltage high wire and a voltage low wire extending through said base housing unit and the length of said light emitting housing with said at least one light emitting element serially coupled thereto.

20. An apparatus as in claim 15, wherein said at least one light emitting element has a first electrical lead in electrical communication with a voltage high terminal of said power source and a second electrical lead in electrical communication with a voltage low terminal.

21. The apparatus as in claim 15, wherein said power source is selected from the group consisting of disposable power cell, rechargeable power cell and solar powered cell.

22. The apparatus as in claim 15, further comprising a second rigid and substantially cylindrical tubular translucent elongated light emitting housing Laying a first end fixedly attached to said back wall of said base housing unit a terminal end.

23. A purse illumination assembly, comprising:

a substantially rectangular base housing unit having a front end, a back end and four sides, wherein, at least one side is removably attachable to said base housing unit, and one side has a plurality of recessed indentations;

a circuit assembly partially contained within said base housing unit said circuit assembly having touch sensitive switching means including a plurality of exposed electrical contacts located within respective ones of said plurality of recessed indentations on said at one of the sides;

a first light emitting housing wherein said first light emitting housing is elongated, rigid and substantially cylindrical and includes a first light source with a first end fixedly attached to said front end of said base housing unit and a terminal end;

a second light emitting housing wherein said second light emitting housing is elongated, rigid and substantially cylindrical and includes a second light source with a first end fixedly attached to said back end of said base housing unit and a terminal end;

a voltage high electrical lead in electrical communication with a voltage high terminal of said power source and a voltage low electrical lead in electrical communication with a voltage low terminal of said power source, wherein said voltage high lead and said voltage low lead extend through said base housing unit and extend down said first light emitting housing and said second light emitting housing:

wherein upon contact of a user hand with said exposed electrical contacts said circuit assembly activates said first light source and said second light source for preset period of time and automatically shifts off said light source after said preset period of time expires; and attachment means fixedly attached to at least one said back end and said four sides, said attachment means removably attaching said base housing unit to an interior surface of a purse.

* * * * *